United States Patent [19]

Wahl

[11] 4,454,709

[45] Jun. 19, 1984

[54] METHOD OF FORMING CONCENTRIC CABLE LAYER AND ARTICLE FORMED

[75] Inventor: Ralph E. Wahl, Trumbull, Conn.

[73] Assignee: General Electric Company, Schenectady, N.Y.

[21] Appl. No.: 357,358

[22] Filed: Mar. 12, 1982

[51] Int. Cl.[3] ..... D07B 7/14; H01B 9/02; H01B 7/34; H01B 13/22

[52] U.S. Cl. ..... 57/223; 57/7; 57/232; 57/233; 174/120 SC

[58] Field of Search ..... 57/210, 223, 232, 233, 57/234, 235, 3, 6, 7, 31, 32; 174/120 SC, 116, 117 F, 119 R, 120 SR, 122 R, 122 C

[56] References Cited

U.S. PATENT DOCUMENTS

| | | | |
|---|---|---|---|
| 2,067,405 | 1/1937 | Mayne | 57/7 |
| 3,589,121 | 6/1971 | Mulvey | 57/223 X |
| 3,909,507 | 9/1975 | Betts et al. | 174/120 SC X |
| 4,125,741 | 11/1978 | Wahl et al. | 57/7 X |
| 4,259,281 | 3/1981 | Lanfranconi et al. | 174/120 SC X |
| 4,342,880 | 8/1982 | Castelli et al. | 174/120 SC X |

*Primary Examiner*—Donald Watkins
*Attorney, Agent, or Firm*—Paul E. Rochford

[57] ABSTRACT

A cable structure having a stranded inner conductor and an insulating layer over the conductor is formed by feeding a tape of semiconducting material onto the wire as it enters an extruder head. The tape is not spirally wound on the conductor but rather is fed longitudinally along with the wire into the extruder head so as to dispose the tape about the wire and beneath the insulation layer extruded thereon. The product formed has a good concentricity and the tape element conforms generally to the stranded wire to provide a minimum thickness of the tape composition to permit the cable to function effectively at medium voltage. The tape employed is preferably a semiconducting tape which can serve to distribute the electrical stresses emanating from the conductor when it is at high voltage. The tape may be formed of a crosslinkable material and the outer insulation may also be crosslinkable. Cable products having crosslinked insulation separated from a stranded conductor by a crosslinked semiconducting layer formed of a ring of crescents may be formed.

14 Claims, 6 Drawing Figures

Fig. 1
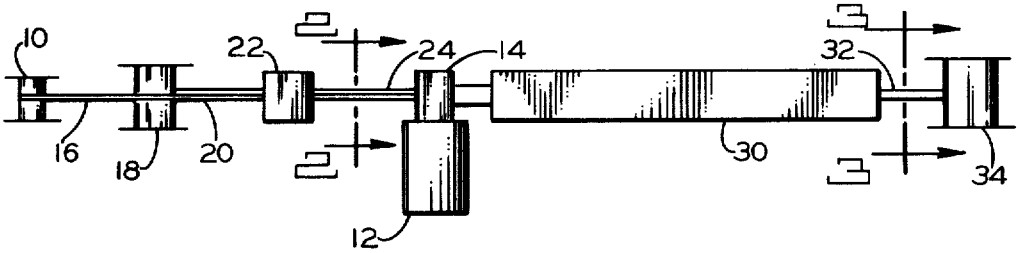
Fig. 2
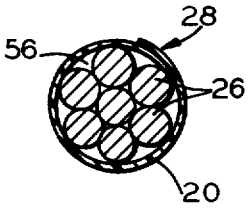
Fig. 3
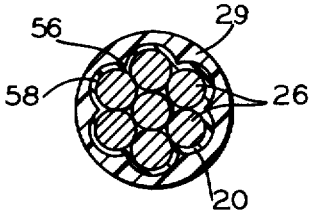
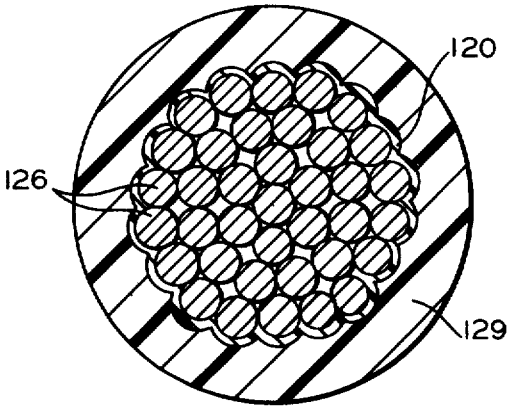
Fig. 4
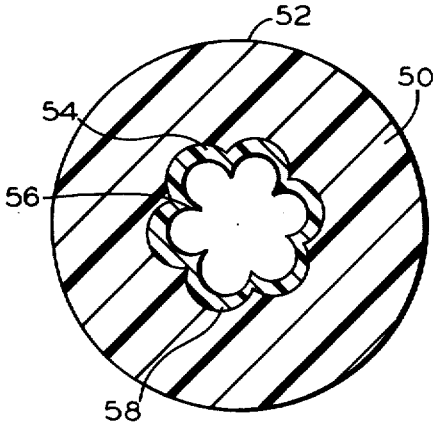
Fig. 5

METHOD OF FORMING CONCENTRIC CABLE LAYER AND ARTICLE FORMED

BACKGROUND OF THE INVENTION

It is common practice in the wire and cable industry to manufacture wire strands and to amass a generally circular central assembly or bundle of elements for cable and to extrude an insulating layer over the assembly. Sometimes, the central bundle of elements is spirally wrapped with a tape to provide a continuous conductor shield bonded to the insulation layer. The tape itself may be overlaid with a semiconducting material or only the overlaid semiconducting material may be used to dissipate the electric stresses emanating from the conductors and prevent concentration of stress in the insulation layer formed about the conductor. In prior art cables, it was deemed that such semiconducting layers should preferably have a regular outer form, and specifically a circular cross-section. The circular cross-section was deemed necessary to minimize the stress concentration at the surface of the semiconductor and prevent such stress from impairing the properties of the insulating layer formed thereabout. The Association of Edison Illuminating Companies has established the standards known as AEIC5 and AEIC6, concerned with the acceptable height of spikes permitted in cables having different diameters and different insulation thicknesses. These standards are similar to the ICEA standard S-66-524 of the Insulated Cable Engineering Association.

It has been pointed out that there are problems associated with extruded semiconducting layers which concern principally the spikes or points of such semiconducting layer which extends into the insulating layer.

In the formation of medium voltage cable, particularly in a range of 5 kilovolts to 35 kilovolts, it has been observed that a nylon base semiconductive tape of butyl composition may give rise to a layer of tape which is deficient or even defective, i.e. tape wrinkles or is not bonded to insulation layer. Also, the extrusion of a semiconducting layer onto an inner conductor, particularly a stranded conductor, involves the use of two extrusion machines in sequence and, accordingly, is a more expensive operation than the use of semiconducting layer about the conductor of a cable. Use of an extrusion machine to produce conductor shield requires a high degree of skill and may result in excentric extrusions. The problem of obtaining concentricity can interfere with the production of suitable cable.

OBJECTS OF THE INVENTION

It is accordingly one object of the present invention to provide a simple method by which a cable having a semiconducting layer can be formed.

It is another object of the invention to provide a method for forming cable of good concentricity having a semiconducting layer over the central conductor and between the overlying insulation and conductor.

Another object is to provide a method for providing a semiconducting layer about a stranded cable without use of fillers or strands to round out the inner conductor configuration.

Another object is to provide a crosslinked conductor shield bonded to the overlying insulation, said conductor shield having no fibrous support integral with it, such as nylon fibers.

A still further object is to provide a crosslinkable conductor shield concentric with conductor outer strands and bonded to the overlying insulation but readily strippable from the conductor strands.

It is another object to provide a crosslinkable conductor shield concentric with conductor outer strands, bonded to overlying insulation but of minimum wall thickness, that is, meets AEIC (AEIC CS5-79, Part D.1) specification of 0.012 inch minimum thickness or ICEA specification of 0.0025 inch minimum thickness (ICEA S66-524, 2.4).

BRIEF STATEMENT OF THE INVENTION

A cable product is formed with stranded conductors and an extruded outer insulating layer. A semiconducting layer is provided about the inner stranded conductor to conform generally to the outer contour of the stranded conductor and to provide a minimum thickness of the semiconducting layer between any portion of the conductor and the corresponding insulating layer which overlays it. One way in which such a configuration of conforming semiconducting material can be formed about a stranded conductor is by providing a strip of semiconducting material having a width at least equal to the outer circumference of the stranded cable and feeding the semiconducting strip loosely folded about the stranded conductor into an extrusion head as an outer insulating layer is being extruded onto and about the inner components of the cable. The product formed is a novel stranded cable having a semiconducting layer which conforms generally to the outer contour of the conductor strands and which has a generally uniform minimum thickness of semiconducting material about the conductor strands along the length of the conductor.

These and other aspects of the invention will be made clearer by reference to the detailed description which follows taken in conjunction with the accompanying drawings.

DESCRIPTION OF THE DRAWINGS

FIG. 1 is a schematic layout of the apparatus used in preparing the product of the subject invention;

FIG. 2 is a cross-sectional view prior to encapsulation of the seven-stranded wire about which is wrapped a strip pursuant to the present invention;

FIG. 3 is a cross-sectional view similar to that of FIG. 2 but having the outer sheath formed on the wire and in place;

FIG. 4 is a cross-sectional view of the cable similar to that of FIG. 3, but incorporating a larger number of strands of cable and having the structure of the present invention;

FIG. 5 is a cross-sectional view of an insulation layer and the fluted inner layer as formed pursuant to this invention.

DESCRIPTION OF THE PREFERRED EMBODIMENT

Figure 6:
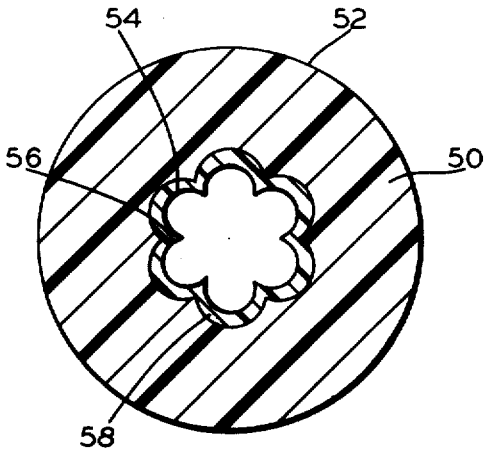
FIG. 6 is a photographic view of a section corresponding to the structure of FIG. 5 and showing an insulation layer and a fluted inner layer as formed pursuant to this invention.

Referring first to FIG. 1, a reel 10 of wire is positioned to feed wire to an extruder 12 having an extruder head 14. The wire strand 16 itself is paid off from the reel 10 and passes over a reel 18 from which is dispensed and paid off a semiconducting tape 20, which tape is aligned with the wire 16 from reel 10. The wire 16 and tape 20 pass through a wrap station 22 where the tape 20 is wrapped about the wire 16 to form the wrapped tubular layer surrounding the wire 24. A section of the wrapped cable 24 is shown in FIG. 2. FIG. 2 is a section taken along the line 2—2 of FIG. 1.

Referring now to FIG. 2, it is evident that the wire employed is a seven-strand conductor 26 having the individual strands in a generally circular form. The tape 20 is wrapped about the composite strand structure and is overlapped at the end 28 where two layers of the tape are evident from the figure. This wrapped composite structure 24 passes through the extruder head 14 of extruder 12 and is sheathed with an outer layer 29 of insulating material (see FIG. 3). The layer 29 plus the cable may then be passed through a treating or curing and cooling chamber 30 from which the treated cable is removed at its opposite end. Treated cable 32 is then taken up on the reel 34 at a reeling station.

Referring now to the FIG. 3, the conductors 26 which are present in the cable of FIG. 2 are still present in the same formation in FIG. 3 as is evident from comparison of the conductors of FIGS. 2 and 3. The semiconducting layer 20, however, has been formed into the fluid construction by being pressed against the conductors by the insulating material of outer sheath 29. This pressing occurs as the wrapped composite structure is applied under high pressure to the cable in the extruder head 14.

Considering next an alternate type of structure which may be formed pursuant to the present invention, there is evident in FIG. 4 a cable having inner strands 126. These multiple strands, which may number 19 or more and correspond to any standard cable configuration, are surrounded at their outer perimeter by a semiconducting layer 120 which layer has been wrapped about the conductor structure 126 prior to extrusion of an outer sheath thereon and prior to entry into an extruder head such as 14 of FIG. 1. After entry into the extruder head, outer sheath 129 is deposited under high pressure on and about the cable structure and its semiconducting tape 120 so that the tape takes the fluted form conforming essentially to the outer configuration of the individual strands of the cable.

There follows a description of a specific example of carrying out the process and forming the product of the present invention.

A seven strand No. 8 AWG conductor was unreeled from a supply reel and fed through an insulation extruder.

A tape having a width of 0.625 inches and a thickness of 0.014 inches was wrapped longitudinally about the conductor just prior to entry into the extruder and the insulation layer was extruded directly over the tape layer.

It was observed that the tape retained its integrity through the extrusion process and that it was forced by the extruded insulation layer to conform to the outer shape of the stranded conductor. It was also observed that there was a relatively uniform minimum thickness of semiconducting layer above each of the strands and that at one portion of the conductor, a slightly greater thickness of the tape material was deposited due to the overlay of the edges of the tape as it was fed into the extruder head.

The development of a relatively uniform coating of the tape material on each of the outer strands of the stranded conductor as a result of passing the tape into and through the extruder head is deemed to be a novel result and to provide a novel structure which involves a central stranded conductor overlaid with an outer insulation layer and having disposed between the two a formed layer of a plastic material having a generally uniform minimum thickness extending around the exposed surface of each of the outer strands of the central conductor. A photograph of a sectioned portion of such a formed layer and outer insulation is provided in FIG. 6. In this figure, an outer ring of insulation 50 has an outer surface 52 of generally circular configuration, and an inner layer of plastic material having six petal-like or fluted segments, all joined into a unified structure.

Each fluted or petal-like segment, such as 54, has a relatively uniform extent of the plastic material disposed in a ring sector form about a circular conductor strand which is not shown in FIG. 6, but which is shown in FIG. 3. The wall thickness of the ring segment is generally uniform for each segment. This uniformity extends to portions of the segment where the external surface of the plastic material is convexly curved. There is a heavier deposit of the material into the crevice or notch formed between two abutting circular surfaces of the respective conductors. A generally inwardly pointed V configuration or interstice of deposited plastic material is formed in the crevices. The V has curved sides which are the result of forcing of the plastic material into the respective crevices 56. At the intersection of the outer surface of two-ring segments with each other, there is formed a generally shallow, concavely curved bottom trough 58, disposed essentially outwardly from the inwardly extending V configuration.

The formation of a layer of plastic material, which may or may not be crosslinkable, about the conductor, which layer has a fluted, petal-like segmented or scalloped configuration and which layer has ring segments which have generally uniform thickness using a non-supported plastic tape, is a novel and unique result. This method presents a structure which has not been available heretofore from the simple longitudinal feeding of a prior art fabric supported curved plastic tape material directly into an extruder head loosely folded about the entering stranded conductor.

Some structures having somewhat similar but not the same configuration have been formed when a yieldable plastic composition is disposed on a fabric support and then cured to a less yieldable composition. The fabric supported cured layer is then interposed between the outer surface of the inner conductor and the overlain insulating plastic. However, the fabric restrains the free and easy flow of the plastic layer. Also, this prior art plastic layer is generally cured at the time of tape manufacture so that the resultant product does not have such a uniquely uniform distribution of the plastic material between the conductor and insulation. Because this fabric supported cured semiconducting layer is cured prior to extrusion of insulation thereon, no chemical bond is formed between the prior art semiconducting layer and the extruded insulation layer. However, and by contrast, such a chemical bond is formed by practice of the present invention.

The layer of plastic material having the scalloped configuration may be any suitable material to be disposed between the conductor and the outer insulation. For medium voltage cable, it is frequently advantageous to have a semiconducting plastic layer, which may be a crosslinked layer, between the insulating outer layer and the conductor itself. This layer can serve to distribute the electrical potential and to prevent its concentrating at a point or spike and lead to a breakdown in the outer insulation. Accordingly, it is feasible to form the scalloped layer in a medium voltage cable of a semiconducting material and to gain the advantage of the avoidance of concentrated points or spikes of high stress acting on the insulation. What has been found to be unique and novel about this structure is that the inner semiconducting layer may have a multiple circular outer perimeter and still be effective in providing distribution of electrical stress and avoidance of concentrated stress in spikes, such as will lead to a breakdown of the outer insulation layer. From FIGS. 5 and 6, it is readily evident that there are certain portions of the semiconducting layer which extend out further than others and there are, in effect, a series of mounds or crowns and troughs extending around the perimeter of the structure with the mounds extending out further into the outer layer of insulating material and the troughs being less extended. What is found to be unique and surprising is that although there are a plurality of mounds formed in the material about the strands and although the mounds conform to the strands and the strands themselves are the conductive material, nevertheless, there is no such high concentration of electrical stress that there is a breakdown or deterioration of the outer cable insulation for a medium voltage cable of the order of 5 to 35 kilovolts.

Design of cables and, particularly, the conductor portions of cables, is done pursuant to standards identified as IPCEA S-66-524 and, particularly, Part 2 of Page 5 of Standard dated June 1976. This standard covers concentric stranded class B aluminum and copper conductors. Specifically for No. 22 AWG through No. 2 AWG conductors, they are made up according to the IPCEA standard of seven strands including one central strand surrounded by six outer strands. This construction conforms to FIGS. 5 and 6 of the drawing.

The next group of conductors based on the IPCEA standard cited above are made up of 19 strands and these are No. 1 AWG, 1/0, 2/0, 3/0 and 4/0. This group has a central strand surrounded by six strands twisted right hand lay with 12 strands twisted left hand lay over the 6 strands.

The third group of conductors, according to the IPCEA Standard cited above consists of 37 strands, one central strand, 6 strands left hand lay, 12 strands right hand lay, and finished with 18 strands left hand lay. The fourth group has 61 strands running-from 550 MCM through 1000 MCM. This latter group has a central strand, 6 strands right hand lay, 12 strands left hand lay, 18 strands right hand lay, and finished with 24 strands left hand lay.

From the foregoing construction, it is evident that the wire with 6 outer conductors will have 6 crowns, or 6 mounds according to the terminology used above, as the configuration of the semiconducting layer disposed between the inner conductor and the outer insulating layer. Also, the 19 strand conductors have 12 crowns or mounds which interface both with the conductor and with the overlaying insulation. The 37 strand conductors have 18 crowns and so on.

The outer insulation employed may be any conventional insulation for medium voltage cable and this may be a crosslinked or non-crosslinked insulation.

The following is a specific example of preparation of the tape for use pursuant to the subject invention. A pelleted composition having the following approximate composition is employed:

| INGREDIENT | APPROX. PERCENTAGE BY WEIGHT |
|---|---|
| Dicumyl peroxide | 1.6% |
| Ethylene-vinyl acetate copolymer resin | 63.6% |
| Conductive Carbon Black of Cabot Corp. sold under the trade designation VULCAN XC-72, ASTM-N472 | 33.6% |
| Antioxidant sold under the trade designation Agerite Resin D | 1.0% |

A composition which has been found suitable for use in preparation of a semiconducting tape is sold commercially in pellet form by Union Carbide under the trade designation HFDA 0580. The tape is prepared by first fluxing pelleted material on a heated, two roll rubber mill. Strips of the fluxed material are then removed from the mill and fed into a three roll calendar. The calendar produces a tape which is 40 inches wide and between 0.015 inches and 0.017 inches thick. The tape is then slit to widths of 9/16 inches, 1¾ inches and 3¼ inches for application longitudinally to different size stranded conductors.

A composition for extrusion onto wire as an outer insulating layer was prepared to include polyethylene and a curing peroxide. The composition was blended at a temperature below the crosslinking temperature of the peroxide used and the peroxide was uniformly dispersed into the polyethylene polymer base. The particular composition of polymer and of peroxide employed does not constitute part of the invention. A number of different plastic base materials, such as polyolefin base materials and different peroxides, may be employed in forming an outer plastic layer over the inner layer deposited from the tape.

The information developed from the extrusion of crosslinkable polymer onto plastic strip is given in the following accompanying Table I.

Following the extrusion of the crosslinkable insulation onto the conductor having the tape wrapped longitudinally around it, the insulated product was introduced into a continuous vulcanization chamber and the peroxide crosslinking of the polymer base was carried out at the elevated temperature of the continuous vulcanization chamber.

The product was cooled by immersion in a water leg before exiting from the high pressure, high temperature continuous vulcanization chamber.

Following the preparation of the cable, it was subjected to a number of tests. The first test involved measurements of the wall thickness at the crowns. The normal procedure for measuring a cable sample's wall dimensions is as follows. First, a cable sample of about 1" long is cut off squarely and then the end of the cut sample is polished. Next, the cable is eye observed to locate visually the minimum wall insulation thickness. Then, a line is drawn throught the center strand and through the two strands between the center strand and the semiconducting layer. Next, a diameter line is drawn which is perpendicular to the first diameter line which was drawn and the sample is then ready for microscopic dimensioning. The microscope used may have digital readout so that the measurement of the wall thickness can be determined from observation and movement of the sample in view of the microscope and yet the amount of movement is recorded on the digital readout. The dimensions are read along the two diameter lines which have been drawn. In this manner, the dimensions of the minimum, maximum and of the perpendicular walls are read. In the examples which follow as, for example, the dimensions given in Table IV below, the wall thickness of the insulation is given with 4 readings which are obtained in the manner described here.

TABLE I

| | #8 AWG 7-Strand 5KV Cable | 2/0 AWG 19-Strand 5KV Cable | 500 MCM 37-Strand 5KV Cable |
|---|---|---|---|
| MACHINE: | 3½" CV* | 4½" CV | 4¾" CV |
| FEED RATE TO EXTRUDER: | | | |
| Conductor Feed in Feet/Minute | 26 | 16 | 23 |
| Tape Feed in Feet/Minute | 26 | 16 | 23 |
| Tape Width | .625" | 1.8125" | 3.5" |
| EXTRUDER: | | | |
| Head Temperature | 240° F. | 245° F. | 240° F. |
| Zone 1, 2, 3 of Extruder Barrel | 240° F. | 250° F. | 250° F. |
| INSULATION PREPARATION: | Pelletized Crosslinkable | Pelletized Crosslinkable | Pelletized Crosslinkable |
| CONTINUOUS VULCANIZATION APPARATUS | | | |
| Steam Pressure | 255 psig | 255 psig | 255 psig |
| Steam Temperature | 408° F. | 408° F. | 408° F. |

*CV is the designation of a conventional continuous vulcanization apparatus as illustrated schematically by "30" of the accompanying FIG. 1.

With regard next to the measurement of the wall thickness of the conductor shield, or the semiconducting layer, a measurement is made through each crown, that is, at the crest of the individual flutes of the fluted configuration formed to conform to the number of strands of the conductor which are in the outer layer of the conductor structure and which are in contact with and conform to the semiconducting layer.

In Table IV, the wall thickness of the conductor shield is given for all 12 crowns of the 19 strand cable which is the subject matter of the test results given in Table IV. The average of the thicknesses, other than the two thicknesses which are apparently overlapped portions of the conductor shield, is 13.47 mils as given in Table IV.

The wall thickness was measured for the #8 AWG 5 KV cable sample similar to configuration to that of FIG. 5. The wall thickness of the inner conductor shield of this insulation measured 12.8, 11.0, 11.2, 15.2, 11.6 and 12.4 mils at the six respective crowns or scallops. The average wall thickness was found to be 12.37 mils.

There were no voids visible from microscopic inspection, and no contamination of the insulation layer was found. Also, it was determined by visual inspection and observation that there were no protrusions or irregularities. Two randomly selected speciments, 1a and 1b, of the #8 AWG 5 KV cable sample were tested for conductor shield resistance at various temperatures and the following results were obtained:

TABLE II

| SAMPLE | TEMP. | RESISTANCE | VOLUME RESISTIVITY IN OHM-CM | SPECIFICATION AEIC-5-79 D.5 FOR RESISTANCE OF CONDUCTOR SHIELD OHM-CM, MAX. |
|---|---|---|---|---|
| 1a | Room Temp. | 8745 | 32.1 | — |
| 1b | Room Temp. | 9034 | 33.1 | — |
| 1a | 90° C. | 85941 | 315.0 | 100,000 |
| 1b | 90° C. | 84891 | 311.0 | 100,000 |

TABLE II-continued

| SAMPLE | TEMP. | RESISTANCE | VOLUME RESISTIVITY IN OHM-CM | SPECIFICATION AEIC-5-79 D.5 FOR RESISTANCE OF CONDUCTOR SHIELD OHM-CM, MAX. |
|---|---|---|---|---|
| 1a | 130° C. | 64577 | 237.0 | 100,000 |
| 1b | 130° C. | 57817 | 212.0 | 100,000 |

The tape heat distortion temperature was found to be 75° C. for melting using standard test procedure ICEA S-66-524, 6.4.14.

Next, the 2/0 AWG 19-strand 5 KV cable was evaluated using standard test procedures. The following test results were obtained:

TABLE III

| INSULATION | TEST RESULTS | RESULTS REQ'D* |
|---|---|---|
| Original Tensile* | 2489 psi | 1800 psi req'd |
| Original Elongation* | 439% | 250% req'd |
| Aged 7 Days at 121° C.* | | |
| % Retention Tensile | 96% | 75% req'd |
| % Retention Elongation | 83% | 75% req'd |
| Mechanical Moisture* @ 70° C. | 1.59 mg/in$^2$ | Not Required |
| Cold Bend Cable* | | |
| −65° C., 1 hour, Mandrel 3", 3 turns | PASS | PASS required |

*Each test is as specified in ICEA procedure above.

For the 2/0 AWG 19-strand 5 KV cable sample as listed in Table I, the following dimensions were found based on measurements at four spaced locations around the cable insulation:

TABLE IV

| DIMENSIONS OF THICKNESS | |
|---|---|
| Wall Thick.-Insulation | 136.5, 128.7, 139.7, 135.1 mils; Average: 135.0 mils |
| Wall Thick.-Conductor Shield | 22.7, 22.3, 14.1, 12.7, 13.9, 15.7, 12.4, 11.5, 11.5, 14.4, 14.1, 13.4 mils<br>Average: 14.975 mils<br>Average of ten readings with no apparent overlap is 13.47 |
| Diameter of Insulation | 696.9, 710.6 mils |
| Diameter of Conductor Shield | 429.9, 431.0 mils |
| Diameter of Conductor | 407.6, 405.1 mils |

These results demonstrate good concentricity of the wire product as well as relatively uniform thickness of conductor shield and insulation.

Further, a number of destructive tests were performed on the 2/0 AWG 5 KV cable of Table I with the following results:

TABLE V

| |
|---|
| Step Breakdown - 54 kV (per AEIC-5-79, High Voltage Time Test) |
| Insulation Wall at Breakdown - 110.9 mils |
| Breakdown Volts per Mil = 486.9 Vpm |

Concerning the advantages made possible by the invention, it will be apparent that less material is used in providing a semiconducting inner layer juxtaposed between the conductor and the insulation outer layer using the scheme of the present invention than is used in prior art schemes. For example, it is noted that the average wall thickness of the 2/0 sample is 14.975 mils. For the same conductor, that is, a 19-strand conductor employing the established and conventional extrusion technique for deposition and formation of the semiconducting layer about the 19-strand conductor prior to the deposition of an outer insulating layer thereover, the shield thickness ranges between 27 and 34 mils. It is noted that the extruded conductor shield is made with a cylindrical outer surface and this sets a different requirement with regard to the thickness of the layer and the range of thicknesses of layer which are used. The thinner layer of semiconducting material can be employed in accordance with this invention because the conductor shield is made with a contoured layer which follows the contour of the strands of the conductor and concentricity is assured because of this novel technique.

Because less semiconducting layer is employed, there is in turn a benefit which is obtained with regard to the total amount of insulating layer which must be applied over the semiconducting layer. The total amount of insulating layer is also reduced.

Further, with regard to the processing and equipment which must be employed, it is apparent that using the novel scheme of this invention, only one extruder is required to produce the cable which has the equivalent of an extruded conductor shield and extruded insulation. Conventionally, such two layers would be formed by two extruders operating in tandem or by use of a dual head extruder.

Numerous other advantages and benefits of the present invention will also be evident to those who are skilled in the art and will be able to form the novel semiconducting layer of this invention from the teaching contained in this application.

For example, the novel cable product of this invention can be cured by high energy radiation such as high energy electrons as an alternative to the chemical curing as disclosed above. Such radiation curing applies to curing of both the outer insulating and the inner semiconducting layer.

As is evident from the foregoing, the novel method of this invention involves use of an unsupported or nonfabric tape as distinct from prior art tapes which have a nylon or other fabric support for the semiconducting material associated with the prior art tape. The results achieved by the present method employing an unsupported tape are not achievable when a fabric supported semiconducting element is employed.

The semiconducting layer over the conductor is known as a conductor shield.

What is claimed and sought to be protected by Letters Patent of the United States is:

1. A method of forming a cable comprising:
providing a multistrand inner conductor,
providing a elongated unsupported semiconducting tape of a width slightly larger than the circumference of the multistrand conductor,
passing the multistrand conductor through an extruder head to extrude an outer insulation layer thereon, and
wrapping said unsupported semiconducting tape about the multistrand conductor prior to its introduction into the extruder head.

2. The method of claim 1 in which the semiconducting tape and the outer insulation are crosslinkable.

3. The method of claim 2 in which the cable is subjected to heat and pressure after being formed to crosslink the tape and outer insulation.

4. The method of claim 2 in which the cable is cured by high energy radiation.

5. A cable structure comprising:
a stranded inner conductor,
a layer of a semiconducting tape over the stranded conductor, the outer surface of which has irregularities conforming generally to the strands of said inner conductor, and
an outer insulation layer over said layer of pliable material.

6. The article of claim 5 in which the layers contain crosslinking agents.

7. The article of claim 5 in which the outer layer is of polyolefin base.

8. The article of claim 7 in which the polyolefin base layer contains a peroxide crosslinking agent.

9. The article of claim 7 in which the layer is crosslinked.

10. The article of claim 5 in which both the inner and outer layers are of polyolefin base.

11. The article of claim 10 in which the layers contain a peroxide crosslinking agent.

12. The article of claim 11 in which the layers are chemically crosslinked.

13. The article of claim 5 in which the outer insulation layer is chemically and mechanically bonded to the insulation and is readily strippable from the stranded conductor.

14. The article made by the process of claim 1 in which the outer insulation layer is of nearly uniform thickness over the outer strands of the conductor except at tape over lap.

* * * * *